US006083671A

United States Patent [19]

Yurow

[11] Patent Number: 6,083,671

[45] Date of Patent: Jul. 4, 2000

[54] PHOTOGRAPHIC DEVELOPER FOR DIRECT PRODUCTION OF EQUIDENSITY IMAGES ON A HIGH CONTRAST FILM

[76] Inventor: Harvey Warren Yurow, 3801 Maryland Ave., Abingdon, Md. 21009

[21] Appl. No.: 09/356,536

[22] Filed: Jul. 19, 1999

[51] Int. Cl.[7] ..... G03C 5/29

[52] U.S. Cl. ..... 430/434; 430/364; 430/367; 430/368; 430/435; 430/487; 430/489

[58] Field of Search ..... 430/364, 367, 430/368, 434, 435, 487, 492

[56] References Cited

U.S. PATENT DOCUMENTS 4,322,493 3/1982 Shibaoka et al. ..... 430/407

5,318,881 6/1994 Bucci et al. ..... 430/434

*Primary Examiner*—Hoa Van Le

[57] ABSTRACT

Equidensity images can be produced directly on high contrast, thin emulsion, fine grain, silver halide process films, such as Kodak Technical Pan Film (RTM), given instantaneous outdoor camera exposure. Photographic development of the film in an aqueous alkaline solution containing a halogen- substituted hydroquinone such as 2-chlorohydroquinone, or 2-bromohydroquinone as developing agent, and thiourea, or a mono N-substituted derivative such as 1-allyl-2-thiourea, as "chemical solarizer", followed by fixation, produces continuous tone violet-blue (negative) and brown to olive-black (positive) images having applicability in semi-abstract artistic photography and in scientific photography.

13 Claims, 1 Drawing Sheet

FIGURE 1. D LOG E CURVE FOR KODAK TECHNICAL PAN FILM (RTM) WITH 2-CHLOROHYDROQUINONE, 1-ALLYL-2-THIOUREA DEVELOPER
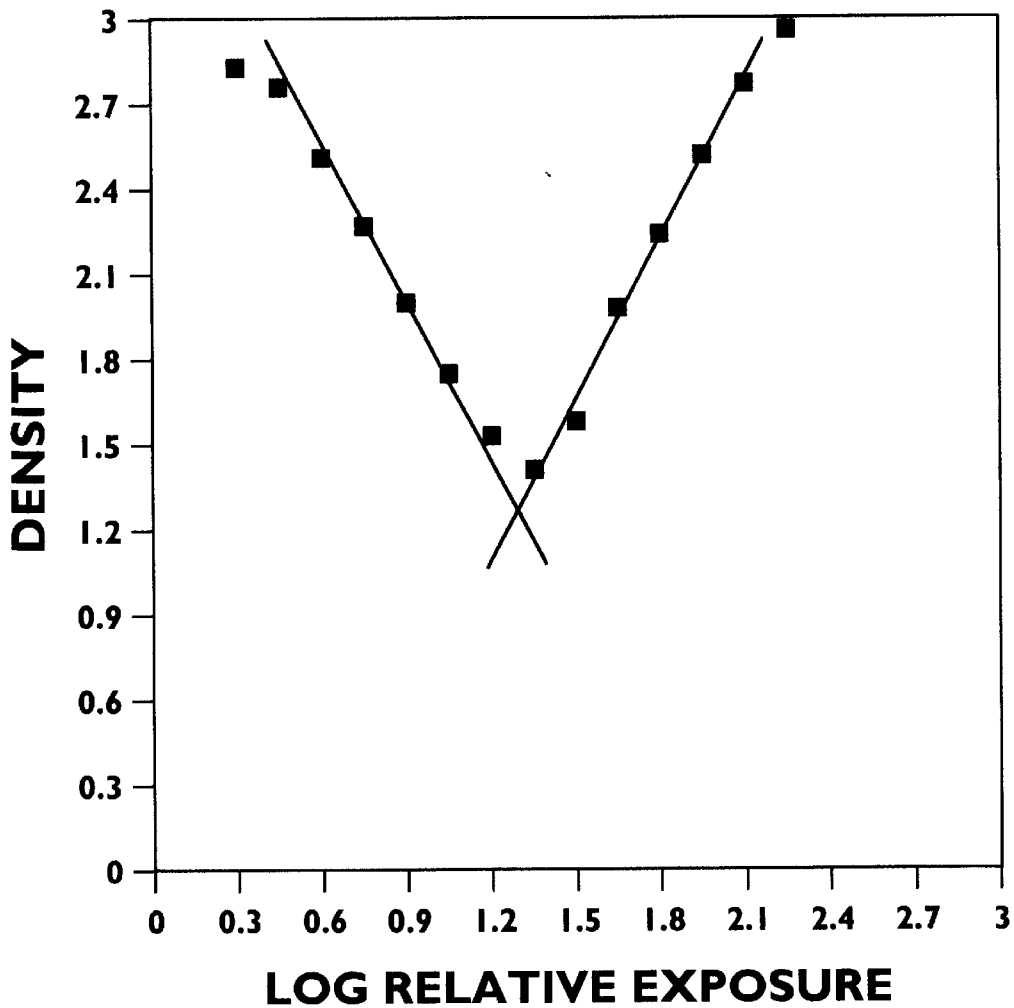

PHOTOGRAPHIC DEVELOPER FOR DIRECT PRODUCTION OF EQUIDENSITY IMAGES ON A HIGH CONTRAST FILM

BACKGROUND OF THE INVENTION

The field of endeavor of the invention is a photographic developing process for the production of equidensity images on a black-and-white, silver halide film. When normally processed, many black-and-white films can give a negative image, whose optical density is directly proportional to an object's luminance, or, if processed by reversal, an inversely proportional positive image. These results are a consequence of the approximate linearity of the well known optical density vs log exposure (D log E) curve. However, for equidensity images, which require special techniques, the resulting D log E curve resembles a trough-shape (in cross-section) , i.e., with a positive (left) branch at lower log E values, a negative (right) branch at higher Log E values, and a minimum density (equidensity) connecting section located in the mid-region of exposure. (refer to FIG. 1., below, for an illustrative curve) As a consequence, depending upon camera exposure selected, bright, mid-tone, or dark objects in a scene to be photographed can be made to stand out as a group, i.e., reproduce as relatively clear (equidensity) areas, while other objects of higher or lower luminances appear in darker tones on the film.

Equidensity images have application in artistic photography, with the production of abstract images, which are partially negative and partially positive, often with clear contour outlines and exaggerated contrast. In addition, equidensity production is of importance in such branches of scientific photography as geology, paleontology and astronomy. However, while art strives for a "one of a kind" image, science regards good reproducibility as being of utmost importance. In this connection, as an aid for the eye to more readily group together objects of comparable densities in a photographic image, the science of equidensitometry has been developed, and is described by E. Lau and W. Krug ("Equidensitometry", Focal Press, London, 1968). Because border effects due to inhibition of development often accompany equidensity, images can frequently be sharpened and made more distinctive by being outlined with a thin, clear (transparency) or white (print) line. In this connection, J. B. Williams ("Image Clarity: High Resolution Photography", pages 5–15, Focal Press, London, 1990) noted that the visual impression of image sharpness and its objective rating of acutance are influenced primarily by edge contrast and edge gradient.

There are four basic photographic techniques currently available for the formation of equidensity film images: bas-relief Sabatier "pseudo-solarization", use of Agfacontour Film (RTM), and "chemical solarization". Solarization is a term originating in the early years of photography and referring to reversal of film following extreme overexposure to light. The use of quotation marks indicates that the aforementioned terms are imprecise, but firmly established in useage. Also, although often spelled in the literature as Sabattier, the correct spelling is Sabatier.

All of these equidensity methods except for "chemical solarization" are not direct and customarily require that a copy be made from an original negative. In this connection, I. R. Verkinderen ("Reversal Processing." British Kinematography 13: 3744 (1948)) has pointed out that copying processes suffer in regard to direct (reversal) processes in that: 1. more steps are involved, 2. graininess is increased and sharpness is decreased, 3. susceptibility to resulting dust spots is greatly increased unless meticulous preventative care is incorporated into the procedure.

Bas-relief uses a negative and a positive, one usually a copy of the other, in either black and white or color, bound together, but slightly out of register. The combination gives a partial positive, partial negative image, with clear and dark lines on either side of the image. (Kodak, "Creative Darkroom Techniques", pages 161–162, Rochester, 1973; L. D. Patterson, U.S. Pat. No. 5,583,601, "Photographic Film Sandwich", Dec. 10, 1996) According to E. Ranz ("Agfacontour-a Film for Isolation of Tones." PSA Journal 37: (December) 33–37 (1971)), "the disadvantages of this method are difficulties in obtaining a clean register of negative and positive and the interval between both emulsions can cause faults in the copy".

The Sabatier effect is usually applied as a darkroom copying process that begins with a negative, an initial exposure onto paper or film, and a controlled second exposure (flashing) partway through development to give partial positive, partial negative images with equidensity areas and white line outlines. Typical trough-shaped D log E curves for the Sabatier effect are illustrated in H. N. Todd and R. D. Zakia, "Photographic Sensitometry", 2nd edition, pages 112–114, Morgan and Morgan, Dobbs Ferry, New York, 1974. However, difficulties connected with a controlled second exposure requirement make reproducibility problematic, especially as it pertains to applying it uniformly to fill roll lengths of 35 mm or 120 film previously exposed in a camera. Again, according to Ranz in PSA Journal 37: (December) 33–37 (1971), "both negative-positive and Sabattier effect involve a circuitous and tedious procedure which yields very poor reproducibility". Further (E. Ranz et al, U.S. Pat. No. 3,941,595, "Photographic Material Containing Fogged, Direct Positive Silver Halide Emulsion for the Production of Equidensities", Mar. 2, 1976), "The Sabattier effect is difficult to reproduce, particularly because it is required to re-expose the layers while they are still moist with very little permissible margin of error. Moreover, there are only a few emulsions which manifest a satisfactory Sabattier effect."

In considerable part because of reproducibility problems encounted with the Sabatier effect, Agfacontour Film (RTM) was invented. It is a black-and-white sheet film used to produce equidensities, but unlike the Sabatier effect, requires, with a starting negative, only one darkroom exposure. It is processed in a typical high-contrast black-and-white developer, but without bromide added as restrainer, as described by Ranz, et al, in U.S. Pat. No. 3,941,595, Mar. 2, 1976. The theoretical basis for Agfacontour Film is the bromide ion diffusion process, i.e., bromide ion released by direct development inhibits solution physical development. Because the film contains two emulsions, one of which develops to a negative and the other either to a positive or a negative depending upon exposure, a trough-shaped D log E curve can be obtained and equidensities can be produced with a single exposure.

Unfortunately, Agfacontour Film suffers from relatively slow speed (only time exposures in a camera are possible), lack of red sensitivity, and extremely high contrast (gamma>7.0), thus yielding few intermediate tones, which often results in loss of image information. (Agfa-Gevaert, "Agfacontour Professional in Photographics", page 18, Leverkusen, West Germany, n.d.)

Subsequent to the introduction of Agfacontour, several patents have appeared with regard to equidensity production. Either they require a special film (M. Grossa, U.S. Pat.

No. 4,595,651, "Process for Producing Equidensity Images Using Photohardenable Material", Jun. 17, 1986), or else make use of special equipment ( H-K Liu, U.S. Pat. No. 4,207,370, "Method of Producing Contour Mapped and Pseudo Colored Versions of Black and White Photographs", Jun. 10, 1980).

Because the eye is about 30× more sensitive to color contrast than to differences in brightness (Lau and Krug, "Equidensitometry", page 34), use of color equidensitometry is advantageous over a black-and-white approach. Preparation of semi-abstract color transparencies utilizing equidensity techniques has become popular over the past three decades. A literature search of the prior art indicates that all such procedures are rather lengthy, requiring a number of steps which usually include copying, and consequently suffer both as regards simplicity of operation and image quality, as compared to the method in this patent. Detailed references to the previous art include: K. M. Acharia, "Conversion of Monochrome Originals to Family of Colour Equidensities." Photographic Applications in Science, Technology and Medicine 10: (1) 17–40 (1975); R. Gareis, and T. M. Scheerer, "Creative Colour Photography", Heering, Seebruck am Chiemsee, West Germany, 1969.

In contrast to the three methods briefly described above, "chemical solarization", which forms the basis of this invention, can produce equidensity images directly in one step. A considerable number of chemical compounds can give "chemical solarization", i.e., induce reversal development of a silver halide in gelatin emulsion without prior exposure to light, when used either in a film prebath, or added directly to developer. Examples of such compounds reported in the prior art are numerous, e.g., G. A. Perley, "Experiments on Solarization." Journal of Physical Chemistry 13: 630–658 (1909) and include: hydrazine, hydrogen peroxide, hydroxylamine, sodium arsenite, and thiourea (thiocarbamide) which has been the most studied.

One proprietary commercial product utilizing "chemical solarization" is found in the Colorvir (RTM) process of the Edwal Company, (W. Hurter. "The Colorvir Process." Petersen's Photographic, pages 32–38 May 1983), where colored toners and tinting dyes are used in conjunction with a "chemical solarizer" to make a slide or print from a starting negative.

The Waterhouse effect, also known as Waterhouse reversal, a "chemical solarization" process forming the theoretical basis of this invention, was first described in 1890 by J. Waterhouse, ("On the Reversal of Negative Photographic Images by Thio-Carbamide." British Journal of Photography 37: 601, 613 (1890); "Thio-Carbamide Reversals." British Journal Photographic Almanac 543–544 (1892), and has subsequently been studied rather intensively: G. A. Perley and A. Leighton, "Preliminary Studies on Direct photographic positives." British Journal of Photography 59: 860–864 (1912); F. C. Frary, et al, "The Direct Production of Positives in the Camera by Means of Thiourea and its Components." British Journal of Photography, 59: 840–842 (1912); S. Wein, "Organic Photographic Developers", pages 108–110, 42nd Street Commercial Studio, New York 1920; A. H. Nietz, "The Theory of Development", pages 147–148, Kodak Monographs on the Theory of Photography, Rochester, 1922; S. O. Rawling, "Thiocarbamide Fog and a Suggested Explanation of Waterhouse Reversal." Photographic Journal 66: 343–351 (1926); I.-G. Farbenindustrie, British Patent 382,815, "Photographic Reversal Processes", Jan. 17, 1931.

As described in the prior art, Waterhouse effect developers consist of a small amount of thiourea (thiocarbamide) $SC(NH_2)_2$, or one of its derivatives, e.g., 1-allyl- or 1-phenyl-, added to a conventional developer containing, e.g., as developing agent, hydroquinone, chlorohydroquinone, pyrogallol, metol, either alone or with hydroquinone, with sodium sulfite as preservative, sodium carbonate to provide a suitable pH, and either no potassium bromide, or a small amount included to moderate the reaction.

Previous work with the Waterhouse effect was mainly concerned with the practical aim of producing a direct positive on film, rather than a partial positive, partial negative "hybrid" (partial reversal), whose occurrence was usually noted briefly in passing. There is little indication in the prior art that these "hybrids", which are actually equidensity images, could be of value in photography. In addition, up to the present, Waterhouse reversal has been of little practical significance, both because of reproducibility problems and because of more efficient bleach and redevelopment techniques currently used to produce color or black-and-white transparencies. The following equations (where DEV refers to a developing agent) are assumed to best describe the reactions taking place in the Waterhouse effect:

$$AgBr+DEV=Ag^{\circ}\text{ (black)}+Br+DEV\text{ (oxidized)} \qquad \text{(equation 1)}$$

Direct development of exposed silver bromide grains comprising latent image to yield negative image, usually in black silver (T. H. James ed., "The Theory of the Photographic Process", 3rd Edition, chapter 13, Macmillan, New York, 1966).

$$AgBr+nSC(NH_2)_2=Ag[SC(NH_2)_2]Br \text{ where } n=1,\ 2 \text{ or } 3 \qquad \text{(equation 2)}$$

Formation of silver bromide-thiourea complexes (James, "The Theory of the Photographic Process", 3rd Edition, page 9).

$$Ag[SC(NH_2)_2]Br+AgBr+2OH^-=Ag_2S+NH_2CN+2Br^-+2H_2O \qquad \text{(equation 3)}$$

Decomposition of silver bromide-thiourea complex on silver bromide grains to give silver sulfide nuclei. This reaction is favored by a higher hydroxyl ion concentration, i.e., higher developer pH. It is also favored by a higher silver ion activity, i.e., lower pAg value, where pAg is defined as the common logarithm of the reciprocal of the silver ion activity. This reaction is strongly inhibited by bromide ion, which raises pAg. (T. H. James and W. Vanselow, "Kinetics of The Reaction Between Silver Bromide and an Adsorbed Layer of Allylthiourea." Journal of Physical Chemistry 57: 725–729 (1953); Rawling, Photographic Journal 66: 343–351 (1926)).

$$Ag[SC(NH_2)_2]_2^+ + DEV \overset{Ag_2S}{=} Ag^0\text{(brown)} + 2SC(NH_2)_2 + DEV\text{(oxidized)} \qquad \text{(equation 4)}$$

Solution physical development of silver ion-thiourea complex present in solution on silver sulfide nuclei to form a brown positive image. Because of the relatively high temperature coefficient of solution physical development, close temperature control for the Waterhouse effect is needed. (James, "The Theory of the Photographic Process", 3rd Edition, pages 363, 369–372; T. H. James, and W. Vanselow, "The Influence of the Developing Mechanism on the Color and Morphology of Developed Silver." Photographic Science and Engineering 1: 104–118 (1958)).

The rather complex reaction scheme described above applies both for Waterhouse reversal (positive formation)

and the partial positive, partial negative images of the invention. It can perhaps best be understood by examining the development processes which take place in film areas that are unexposed, moderately to heavily exposed, and lightly exposed in the camera or darkroom. In unexposed film areas (deep shadows), direct development (equation 1, above) is negligible. Reaction of thiourea with silver bromide grains in the emulsion forms a thin surface layer of a complex, e.g. $Ag[SC(NH_2)_2]Br$ as given in equation 2. In the absence of excess bromide ion (formed as byproduct of direct development of silver bromide and acting as a powerful inhibitor of decomposition by decreasing free silver ion concentration), the complex decomposes to silver sulfide nuclei on grains of silver bromide, shown in equation 3. The rate of decomposition of the silver bromide-thiourea complex varies as the 1.5 to 2.0 power of the hydroxide ion concentration, according to James and Vanselow (Journal of Physical Chemistry 57: 725–729 (1953)) Consequently, rigorous control of developer pH is essential for good reproducibility. This point is elaborated upon in "Detailed Description of the Invention".

Silver sulfide nuclei can initiate solution physical development (equation 4) of unexposed grains of silver bromide, with silver ion provided by its thiourea complex. A brown silver deposit is often characteristic of solution physical development. This type of development corresponds to the left (positive) branch of the trough-shaped D log E curve (FIG. 1, below).

In heavily to moderately exposed areas (scene highlights), direct development of the latent image produced on silver bromide is relatively rapid (equation 1). Silver is customarily deposited in a black form, and bromide ion byproduct slows down formation of, and strongly inhibits decomposition of silver bromide-thiourea complex (equation 3), thus preventing formation of silver sulfide. Released bromide ion can also diffuse in the emulsion layer a short distance across borders from highlight areas, where it is produced in high concentrations, into proximate shadow areas where its concentration is much smaller. The result is low-density edge effects, or so-called image contour lines, via inhibition of silver sulfide formation. Moderate or heavy exposures are not suitable for traditional Waterhouse reversal, where essentially only a positive image is desired, and therefore only a small portion of the negative (right) branch of the D log E curve is utilized. For producing equidensity images with comparable positive and negative image densities, it is necessary to give sufficiently long exposures to utilize both branches of the D log E curve.

Developers containing thiourea plus high concentrations of both ammonium and bromide ions (to enhance solution physical development) often give blue tones (C. E. K. Mees, "New Methods of Lantern-Slide Making on the Wratten Plate." British Journal of Photography 57: 726 (1909); B. T. J. Glover ("Thiocarbamide and Blue-Toned Lantern Slides." British Journal of Photography 70: 135–138 (1923)). Size and shape of silver particles strongly affect light scattering and hence color. (D. C. Skillman and C. R. Berry, "Effect of Particle Shape on the Spectral Absorption of Colloidal Silver in Gelatin." Journal of Chemical Physics 48: 3297–3304 (1968))

In lightly exposed areas, along with a trace of silver deposited by direct development, the small amount of liberated bromide ion is sufficient to inhibit silver sulfide formation (equation 3), so that total development here is minimal, density is low, and equidensity (relatively clear) areas result, i.e., the lowest portion of the trough-shaped D log E curve.

Significantly, beginning with Waterhouse's original report, workers in this field have commented upon large variability in results due to small changes in concentration of developer components, or in temperature of development, (necessitating working conditions as low as 12° C.) and the consequent problem of obtaining good reproducibility. Because of competing reactions as indicated above, it is understandable why problems of reproducibility usually accompany the Waterhouse effect. Therefore, one objective of the invention is to obtain good reproducibility.

Examination of the previous art as referenced above, indicates that various combinations of developing agents and photographic emulsions have been utilized in the Waterhouse effect in a rather haphazard way. In this patent, consideration of current theories of photographic development, in conjunction with a mechanism for the Waterhouse effect (Rawling), and a scientific approach to equidensity production (Lau and Krug), allows one to put the investigation on a more systematic basis and makes possible a more suitable match between developer and film As indicated above, the list of developing agents reported for Waterhouse reversal includes, hydroquinone, 2-chlorohydroquinone, pyrogallol, metol and amidol. However, an ideal developing agent for Waterhouse processing to a partial negative, partial positive equidensity image should, at a pH where silver sulfide formation is rapid, have reaction rates which are both relatively rapid and comparable in magnitude for direct development (equation 1) and for solution physical development (equation 4). In this connection, R. W. Henn found that rates for both these types of development are closer in value to each other for 2-chlorohydroquinone than for hydroquinone ("Properties of Developing Agents. 1. Hydroquinones." PSA Journal (Photographic Science Technique) 18B: 51–55 (1952)) as did Tong, (L. K. J. Tong, C. A. Bishop and M. C. Glasmann, "Oxidation and Development Rates for Hydroquinones." Photographic Science and Engineering 8: 326–328 (1964)).

Also of possible relevance, is a report that the rate of solution physical development on silver sulfide nuclei by hydroquinone, and presumably also by its homolog 2-chlorohydroquinone, is considerably greater than that of metol or phenidone, according to D. C. Shuman, and T. H. Thomas ("Kinetics of Physical Development." Photographic Science and Engineering 15: 42–47 (1971)). The various chloro- and bromo-substituted hydroquinones, which, in theory, show considerable promise for equidensity production, were introduced as developing agents around 1897 by Schering in DRP 117,798 1897, and reported upon by A. and L. Lumiere, and A. Seyewetz ("On the Developing Power of Hydroquinone Substituted Compounds." British Journal of Photography 61: 341 (1914)), and by Nietz ("Theory of Development", page 140).

In connection with Waterhouse development, a variety of film types have been reported by workers in the field, including: moderate speed, relatively low contrast negative emulsions (Waterhouse, Frary, Nietz), slow speed, contrasty lantern slides (Perley) and slow, contrasty process films (Rawling).

Two basic properties of a photographic film of interest here are contrast and speed. Lau and Krug ("Equidensitometry", pages 21–22, 26–27), discussing film contrast in equidensitometry, indicate that "with materials of low gamma value, wide equidensities of poor definition are obtained, whereas with materials of high gamma value, sharp narrow lines are produced." Unfortunately, informational content of a photographic image, as defined by tonal gradation, does not increase without limit as contrast (gamma) increases. Excessive negative contrast reduces gradation of tones, as discussed by Williams ("Image Clarity: High-Resolution Photography", page 81). Therefore, film of some intermediate contrast range is indicated.

The property of film speed dictates whether an equidensity image requires a timed exposure, either in a camera, or under an enlarger, or can be obtained by instantaneous exposure in a camera. Obviously the latter possibility affords much greater convenience and a wider variety of available subject matter; consequently, a fairly rapid film should be tested. Currently, there are four general types of films available to a photographer: Lippmann-type emulsions, microfilms, process films, and general-purpose films. (Williams, "Image Clarity: High Resolution Photography", page 91). In practice, the first two can be ruled out for use with instantaneous camera exposures because of insufficient speed, and the last because of insufficient contrast, thus leaving process films from which to make a selection for suitable equidensity images. Within this group, too high a contrast excludes the lithographic films.

Included among process films are the fairly recent so-called "high resolution" films, which are characterized by thin emulsions, extremely fine grain, extremely high resolving power, and flexible processing to a wide range of contrasts and concurrent exposure indices. (H. Holden and A. Weichert, U.S. Pat. No. 3,772,019, "Novel Developer and Process", Nov. 13, 1973) These films are good candidates for equidensity production with Waterhouse development. An example is Kodak Technical Pan Film (RTM), which is capable of development to fairly high contrast, i.e., gamma of 3.5 or contrast index of 3.0, as described in publication P-255. "Kodak Technical Pan Films", Rochester, 1987. This film has a relatively high exposure index of 320 when developed to maximum contrast, and extended red sensitivity, which permits better tonal representation.

In summation, as can be seen from discussion of the prior art, one objective of the present invention is a process for direct formation of continuous tone equidensity images requiring only one exposure, which is also an instantaneous camera exposure.

A second objective is to obtain good reproducibility in the development process.

A third objective is the production of images with good tonal gradation in at least two colors.

It is believed that these objectives have been achieved in the patent with a combination of 2-chlorohydroquinone (developing agent), 2-allyl-1-thiourea ("chemical solarizer") and Kodak Technical Pan Film, in conjunction with a procedure involving precise control of developer component concentrations, and of development conditions.

BRIEF SUMMARY OF THE INVENTION

An aqueous developer containing 2-chlorohydroquinone as silver halide reducing agent, 1-allyl-2-thiourea as chemical "solarizer", sodium sulfite as preservative, sodium metaborate as accelerator, and boric acid added as pH adjuster, is used to develop rolls of Kodak Technical Pan Film (RTM), given instantaneous outdoor camera exposures. Thus, one obtains directly transparencies of considerable artistic merit, having continuous tone equidensity images which are partially positive (brown to olive-black tones) and partially negative (violet-blue tones), along with essentially clear (pale gray) equidensity areas and clear line outlines around various image areas. The invention is considerably simpler than more complicated techniques of the previous art including bas-relief, Sabatier "solarization", or use of Agfacontour Film (RTM). Besides giving good reproducibility, the present invention overcomes limitations of the prior art in that inherent advantages of direct over copying processes come into play, leading to images of enhanced detail and informational content, of applicability in scientific photography.

BRIEF DESCRIPTION OF THE DRAWING

FIG. 1. A plot of optical density vs log relative exposure for an equidensity image resulting from partial reversal of Kodak Technical Pan Film (RTM) with a photographic developer containing sodium sulfite, 2-chlorohydroquinone, sodium metaborate, sodium tetraborate and 1-allyl-2-thiourea in aqueous solution. Positive (left) and negative (right) branches of the curve are indicated by an approximate trough-shape, with the former having a gamma value of 1.8 and the latter having a value of 2.0. Equidensity is represented by a region of minimum density between the positive and negative branches and has an exposure latitude of about one-half stop.

BRIEF DESCRIPTION OF THE FILM SAMPLE INCLUDED HEREIN

In order for the reader to better visualize the nature of the invention, are ten representative examples of 35 mm equidensity images produced by the invention. Because of the relatively high overall density of the slides, viewing should be with a fairly strong light source in conjunction with a magnifier. Particularly noteworthy are the violet-blue tones of high reflectivity landscape objects (negative image), the brown to olive-black tones of low reflectivity objects and shadow areas (positive image), the relatively clear equidensity areas, and the clear contour lines at borders connecting the two color areas.

DETAILED DESCRIPTION OF THE INVENTION

The photographic developer of the invention is prepared from commercially available chemicals, with the following as the two preferred formulations:

| Formulation 1 | |
|---|---|
| Water, distilled (about 18–24° C.) | 500 cc |
| Sodium Sulfite anhydrous | 18.0 grams |
| 2-Chlorohydroquinone | 5.0 grams |
| Sodium Metaborate tetrahydrate | 40.0 grams |
| Boric Acid | 2.5 grams (approximate, see below) |
| 1-Allyl-2-thiourea | 0.75 grams |
| Water, distilled, to make | 1000 cc |

The above formulation is suitable for those individuals who prefer to make up their own developers by weighing out various amounts of solid chemicals, which are then dissolved in sequence in water for use. Recommended are "photo grade" or USP grade chemicals. Sodium metaborate tetrahydrate is also available as Kodak Balanced Alkali (RTM).

Distilled water is advised rather than tap water because it is less likely to vary in pH from batch to batch, and because of the lower concentration of trace metal fogging agents present. (Mason, "photographic Processing Chemistry", pages 51–54)

More popular at present, because they require less preparation time, are processing kits containing concentrated stock solutions, which are mixed together in the required proportions and diluted with water just before use.

| Formulation 2 | |
|---|---|
| Solution A | |
| Water, distilled (30–40° C.) | 400 cc |
| Sodium Sulfite anhydrous | 63.0 grams |
| 2-Chlorohydroquinone | 17.5 grams |
| Water, distilled, to make | 500 cc |
| Solution B | |
| Water, distilled (30–40° C.) | 350 cc |
| Sodium Metaborate tetrahydrate | 140.0 grams |
| 1-Allyl-2-thiourea | 2.70 grams |
| Water, distilled, to make | 500 cc |
| Solution C | |
| Boric Acid | 10 grams |
| Water, distilled (30–40° C.) to make | 250 cc |

A developer prepared from Formulation 2, corresponding closely to that of Formulation 1, is made by adding 35 cc of A and 35 cc of B to 160 cc of distilled water, followed by approximately 15 cc of C (see below).

As is indicated in the following preparation of patent developer, two key steps are usually necessary in order to obtain satisfactory equidensity images in a consistent manner. One step involves adjusting pH within a relatively narrow range. The second step requires that dichiorohydroquinone impurities accompanying 2-chlorohydroquinone, when present in amounts giving excessive positive density, undergo treatment to reduce their developer concentrations.

In preparing Formulation 1 or 2, a preliminary evaluation must be made of the purity of the available 2-chlorohydroquinone. The need for this step is predicated on the assumption that commercial samples of this compound contain varying amounts of isomeric dichlorohydroquinones which contribute significantly to positive density produced in the equidensity image. The rationale for this procedure is considered below in a detailed discussion on commercial 2-chlorohydroquinone.

Following either Formulation 1 or Formulation 2, all of the components except boric acid are dissolved in sequence in distilled water, allowed to equilibrate for an hour or two, and then filtered to remove any sediment. Next, the pH is adjusted to a value of 10.20, halfway between 10.10, where positive density formation begins, and 10.30, where it becomes excessive. For this purpose, in conjunction with a suitable pH meter, one adds from a graduated cylinder, buret or pipet, sufficient volume of a 4.0% solution of boric acid (which is converted in developer to sodium tetraborate) to lower the pH to the 10.20 aim point.

In the absence of a pH meter, varying amounts of boric acid are added to developer e.g., starting with 2.5 grams/liter and using increments of ±0.25 grams/liter, and test strips developed and examined as indicated below.

Next, the prepared developer is used to develop a test strip of Kodak Technical Pan Film (given a basic outdoor sunshine camera exposure of 1/125 second at f4.9), for a recommended time of 5.0±0.5 minutes at 20±0.5° C., followed by customary fixation, washing and drying.

Recommended slide viewing is with a strong light source and a magnifier. A "preferred" image rendition is, generally speaking, one where positive density is relative long scale, i.e., from tan to medium brown to olive-black, and where contour lines and equidensities have relatively low density. (Refer to Attachment 1.). Subjectively speaking, shadow areas often appear to have a "glowing" effect. If the slides are satisfactory, and here, because of the semi-abstract nature of the images, personal preference plays an important role, then the developer may be used as such, with the requisite amount of boric acid already having been determined.

If positive density is less than is desired, then developer pH aim point is raised from its recommended value of 10.20, e.g., in increments of e.g., 0.05 units, by addition of less boric acid, in order to obtain higher positive densities.

However, as is more likely, if the test strip is found to have excessive positive density, and gives relatively dark equidensities and contour lines, leading to low overall transmission, then the 2-chlorohydroquinone as used, contains a relatively high percentage (>5%) of dichiorohydroquinone impurities. Three techniques are available in the invention to lower excessive positive density and thus give better overall gradation: 1) reduce dichlorohydroquinone concentration to an acceptable level by developer pretreatment, which involves air oxidation to innocuous sulfonates, 2) add potassium bromide to developer, e.g. 0.2–0.4 grams/liter (Nietz, "The Theory of Development", pages 147–148), 3) lower pH aim point below 10.20. Of the three procedures, partial air oxidation gives the best image gradation, and is the one which is recommended.

Pretreatment is performed as follows. Developer is prepared with all components except boric acid according to one of the above formulations, but with only 50% of the total volume of water used to make up the solution. Developer is stored for approximately a 48 hour period before actual use in a stoppered, half-filled bottle, the remainder being air. The 50% figure assumes a relatively high concentration (>5%) of dichlorohydroquinones. Obviously, lower, but still excessive initial positive density necessitates a smaller volume percentage of air, e.g., somewhere within the range 50–20%. Maximum air-liquid surface contact is provided by use of a flat-sided bottle stored on its side. The solution is then made up to volume, filtered if necessary to remove sediment, and adjusted to pH 10.20 with boric acid as indicated previously, before being used to develop test strips. Pretreatment appears to offer the best method of "fine-tuning" positive density in the patent invention.

Once prepared, developer can be stored for at least several weeks in tightly stoppered bottles before use. Preferably, developer should be used in a "one-shot" procedure with 250 ml being required per 20–24 exposure roll of 35 mm film. It is recommended that developer not be reused because of significant decrease in pH and in 1-allyl-2-thiourea concentration, and increase in bromide ion concentration, all of which can produce decreased positive density.

With regard to substitutions in the formulations, the developing agent 2-bromohydroquinone (2-Br-1,4-$(OH)_2CH_3$), can satisfactorily replace 2-chlorohydroquinone in the patent at 6.5 grams/liter, with neutral brown positive tones being replaced by warm brown ones.

While thiourea and 1-allyl-2-thiourea ($CH_2{=}CHCH_2$) $NHCSNH_2$, can be interchanged in the most preferred formulation at equimolar concentrations, the latter is a better choice because of the significantly greater range of positive densities that it produces, i.e., tan, brown, and olive black tones, as compared to only tan and brown tones for thiourea. Other monosubstituted thioureas mentioned in the prior art, such as 1-methyl, 1-ethyl, or 1-phenyl-, while not investigated in this patent, would be expected to be satisfactory substitutes as "chemical solarizers".

Sodium sulfite is the preferred preservative, but can be replaced by the potassium salt.

One can substitute aqueous solutions of sodium tetraborate decahydrate ($Na_2B_4O_7.10H_2O$) for those of boric acid, but the former suffers from lower water solubility. While not investigated here, an alternative buffering system at pH 10.2 consisting of sodium carbonate and sodium bicarbonate should be suitable as replacement.

A moderate degree of leeway is possible in variation in concentration of components of patent developer. Sodium sulfite can be varied between 16–24 grams/liter, 2-chlorohydroquinone between 4–6 grams/liter, and sodium metaborate between 35–45 grams/liter, with only slight change in results. However, concentrations of 1-allyl-2-thiourea should be held to fairly closely, i.e., within 0.70–0.80 grams/liter; decreased values give lower positive densities, and increased concentrations tend to give overly dense slides.

None of the aforementioned chemicals require special precautions outside of safe laboratory practice, except for thiourea or 1-allyl-2-thiourea, which are appreciable skin or eye contact hazards and should be handled accordingly. Spills of these compounds can be decontaminated with household bleach.

The air-ageing of patent developer described briefly above, to lower positive density to an acceptable value, can perhaps be best understood by the following line of reasoning, which, while not proven experimentally in this patent, appears to fit the observed facts.

The developing agent of choice, 2-chlorohydroquinone (2-Cl-1,4-$(OH)_2C_6H_3$,), is commercially available in practical or technical grades. In a Kodak patent (G. F. Rogers, U.S. Pat. No. 2,748,173, "Process for Preparing Monochlorohydroquinone", May 29, 1956), hydroquinone is chlorinated in aqueous acetic acid to give on purification by crystallization, a product containing the following approximate percentages: 2-chlorohydroquinone 87%, 2,5-dichlorohydroquinone 7%, 2,3-dichlorohydroquinone 2%, unreacted hydroquinone 4%. Presumably, this composition approximates that of the commercial practical grade product.

The dianionic species for hydroquinone and for substituted hydroquinones is primarily responsible for both direct development, which controls negative density, and solution physical development, which is responsible for positive density in the equidensity image (R. W. Henn, "Properties of Developing Agents. I Hydroquinone." PSA Journal (Photographic Science Technique) 18B: 51–55 (1952). Furthermore, because the rate of solution physical development for 2,5-dichlorohydroquinone is about 6× greater than that for 2-chlorohydroquinone (value extrapolated from L. K. J. Tong, C. A. Bishop and M. C. Glesmann, "Oxidation and Development Rates of Hydroquinones." Photographic Science and Engineering 8: 326–328 (1964), any process that significantly increases the concentration ratio of 2-chlorohydroquinone to 2,5-chlorohydroquinone in developer solutions should result in noticeably lower positive density.

This concentration ratio increase is practical because 2,5-dichlorohydroquinone (and presumably the 2,3-isomer) is a stronger dibasic acid ($pK_2$=10.00) than is 2-chlorohydroquinone ($pK_2$=11.00). (R. G. Willis and R. B. Pontius "The Relative Importance of Adsorption and Electrode Potential in Determining the Rate of the Induction Process During Photographic Development. II. Hydroquinones." Photographic Science and Engineering 14: 149–142 (1970)) Consequently, even though in solid material a typical concentration ratio of the 2-chloro- to the 2,5-dichloro compound is about 87:7, in solution at pH 10.20, the concentration ratio of their dianions is only about 3:1. Furthermore, because 2-chlorohydroquinone and 2,5-dichlorohydroquinone are reported to react at comparable rates with silver bromide as oxidant, it is considered likely that their dianions also react with oxygen at rates comparable to each other to form the relatively inactive sulfonates. (T. H. James and G. C. Higgins, "Fundamentals of Photographic Theory", 2nd edition, pages 116–117, Morgan and Morgan, New York, 1960). Therefore, because 2,5-dichlorohydroquinone is initially present in much smaller concentration in developer than is 2-chlorohydroquinone, air ageing (equation 5) decreases its concentration percentagewise much more rapidly, thus leading to a greater concentration ratio and a significant lowering of positive density.

$$2,5\text{-}Cl_2\text{-}1,4\text{-}(ONa)_2C_6H_2+O_2+2Na_2SO_3=2,5\text{-}Cl_2\text{-}1,4\text{-}(ONa)_2C_6H(SO_3Na)+Na_2SO_4+NaOH \quad \text{(equation 5)}$$

However, it should be noted that lowering of concentrations of dichlorohydroquinone impurities present in 2-chlorohydroquinone developer in this patent does not imply a necessity in reducing the value down to 0%, and does not preclude the possibility of adding small known amounts of 2-3-, or 2,5-dichlorohydroquinone to relatively pure 2-chlorohydroquinone, or perhaps even to another developing agent, for the purpose of obtaining positive density at a desired gradation range.

It should also be noted that dichlorohydroquinone impurities may be inhomogeneously distributed in commercial samples of 2-chlorohydroquinone. If true, then there is a distinct advantage with regard to good reproducibility in preparing small volumes of developer from concentrated stock solutions (Formulation 2), rather than from individual weighings of components (Formulation 1).

In regard to the film used in the invention, Kodak Technical Pan Film (RTM), available in rolls as 35 mm or 120 size (sheet film sizes are also manufactured), is customarily given an instantaneous camera exposure. A typical outdoor exposure for a semi-distant scene with bright summer sunlight is 1/125 sec. at f4.9, corresponding to an approximate ISO exposure index of 12. Exposure latitude is approximately plus ½ stop to minus 1 stop.

As indicated previously, recommended development of exposed film is for 5±0.5 minutes at 20°±0.5° C. (67–69° F.), in an invertible daylight film tank. Other suitable times and temperatures may be determined experimentally, keeping in mind that formation rate for positive density is more sensitive to temperature change than is that for negative density, so that as with pH, there is probably a relatively restricted range within which to obtain acceptable equidensities.

Because the film is quite susceptible to non-uniform processing effects with invention developer, the following procedure is recommended. Initial agitation is for the first thirty seconds, alternating up-and-down and inversion motions at 5 second intervals, followed by rapping of tank against a hard surface to dislodge air bubbles, a source of pinholes to which the film is prone. Subsequent agitation is for 5 seconds/30 seconds, alternating inversion and up-and-down cycles. Sequential processing steps consist of treatment in acidic stop bath, fixation in sodium thiosulfate (hypo), washing, sponging to remove silver deposited as surface sediment, rinsing with aqueous wetting agent, and drying.

A D log E curve derived from the invention (FIG. 1) using Formulation 1 was obtained by standard procedure using a step wedge and a densitometer. Typically, for the negative section of the curve, maximum density around 3.0 and gamma of about 2.0 were recorded. For the positive section, corresponding values were 2.8 and 1.8. Equidensity was at 1.4, with a width of approximately 0.15 log exposure units. The curve obtained resembles those reported by Nietz ("Theory of Development", pages 147–148) for partial Waterhouse reversal, but has much steeper slopes.

With the recommended outdoor exposure, the D log E curve of the invention translates into actual landscape slide renditions as follows. (refer to Attachment 1.). Objects of relatively high luminance, e.g., sky, clouds, light colored buildings or monuments, give shades of violet-blue, varying from light to deep (negative image). Relatively low luminance structures or monuments, deeper shadows and tree canopies (lower sensitivity of Kodak Technical Pan Film to green radiation) reproduce from tan to medium brown to olive-black (positive image). Relatively clear transparency areas (equidensity) result from objects having luminance factors of about 0.1 (10% reflectance), e.g., aged granite building blocks, weathered wood, grass, asphalt roads, various bodies of water, and more distant objects on hazy days. Low-density contour lines are most prominent at borders between olive-black and dark violet-blue areas.

In the production of equidensity images with the invention developer, selected films suffer an appreciable loss in contrast and in film speed as compared to published results with high contrast metol-hydroquinone negative developers. Thus, for Kodak Technical Pan Film, gamma decreases from 3.6 to about 1.8–2.0 and exposure index drops from 320 to 12, or a loss of about 4.5 stops, which, fortunately, is still sufficiently rapid to allow for instantaneous exposures. With Kodak Fine Grain Release Positive Film (ASA of 40), customarily used to prepare positive prints from motion picture negatives, decrease in gamma is comparable to that given by Kodak Technical Pan Film, and speed loss is 5 stops, which just barely allows for instaneous exposure production of equidensity images. This significant speed loss results largely from the requirement that both branches of the D log E curve be fully utilized.

The patent invention in not limited to the foregoing, specifically mentioned process films, as other films with similar emulsion properties would be expected to behave similarly when processed in the patent developer.

What I am claiming in this patent is:

1. A method of producing a two color, continuous-tone equidensity photographic image comprising:

processing an imagewise exposed black-and-white silver halide photographic film with an aqueous developing composition comprising:

a halogen-substituted hydroquinone as a developing agent, sulfite as an antioxidant and preservative, borate as a buffer, thiourea, or a mono N-substituted thiourea, as a "chemical solarizer".

2. The method of claim 1, wherein the black-and-white film includes high contrast, thin emulsion, fine grain, silver halide process films.

3. The method of claim 1, wherein the black-and-white film is given an instantaneous camera exposure.

4. The method of claim 1, wherein the colors produced for the equidensity image are brown for the positive portion and violet-blue for the negative portion.

5. The method of claim 1, wherein the halogen-substituted hydroquinone developing agent is 2-chlorohydroquinone, 2-bromohydroquinone, 2,3-dichlorohydroquinone, 2,5-dichlorohydroquinone, 2,6-dichlorohydroquinone, 2,3-dibromohydroquinone, 2,5-dibromohydroquinone, 2,6-dibromohydroquinone, or any mixture thereof.

6. The method of claim 1, wherein the "chemical solarizer" is thiourea, or mono N-substituted thioureas, including, but not limited to 2-allyl-1-thiourea or 2-phenyl-1-thiourea.

7. The method of claim 1, wherein said aqueous black-and-white developing composition comprises: 2-chlorohydroquinone, sodium sulfite, sodium metaborate, sodium tetraborate and 1-allyl-2-thiourea.

8. The method of claim 7, wherein the pH of said black-and-white developing composition is between 10.15 and 10.25.

9. The method of claim 7, wherein said 2-chlorohydroquinone is present in said black-and-white developing composition from about 0.028 to 0.041 moles/liter, said 1-allyl-2-thiourea is present at about 0.0060 to 0.0070 moles/liter, said sodium sulfite is present at about 0.13 to 0.19 moles/liter, said sodium metaborate is present at about 0.25 to 0.33 moles/liter and said sodium tetraborate is present at about 0.008–0.012 moles/liter.

10. The method of claim 7, wherein positive density produced with the said black-and-white developing composition can be "fine tuned" to a given range by submitting developer to preliminary ageing in a partially air-filled, stoppered bottle to reduce concentration levels of those developing agent impurities giving relatively high positive densities.

11. The method of claim 7, wherein the developing time is 5.0±0.5 minutes.

12. The method of claim 7, wherein the developing temperature is 20±0.5° C. (67–69° F.).

13. The method of claim 7, wherein development is followed by conventional treatment in aqueous thiosulfate to remove undeveloped silver halide.

* * * * *